US005298872A

United States Patent [19]

Trump et al.

[11] Patent Number: 5,298,872

[45] Date of Patent: Mar. 29, 1994

[54] LOW PROFILE HEATER AND SUPPORT ASSEMBLY FOR YIG SPHERES

[76] Inventors: David Trump, 2939 Agate Dr., Santa Clara, Calif. 95051; John Dunseth, 44951 Gardenia Way, Fremont, Calif. 94538

[21] Appl. No.: 17,824

[22] Filed: Feb. 16, 1993

[51] Int. Cl.[5] ..... H01P 1/218; H05B 3/06

[52] U.S. Cl. ..... 333/202; 333/219.2; 219/504; 219/530; 219/540; 165/80.1

[58] Field of Search ..... 333/202, 219, 219.2; 219/504, 505, 530, 535, 539, 540, 536, 537; 165/80.1; 331/96, 107 G

[56] References Cited

U.S. PATENT DOCUMENTS 3,828,292 8/1974 Grossman et al. ..... 219/504
4,334,201 6/1982 Shores ..... 333/202
5,221,912 6/1993 Keane et al. ..... 333/219.2 X

*Primary Examiner*—Seungsook Ham
*Attorney, Agent, or Firm*—Ron Fish

[57] ABSTRACT

A new type of heater support structure for YIG sphere support rods used in high frequency YIG oscillators and filters. The heater structure employs a rubber O-ring stretched around the perimeter or one or more rubber rods threaded through holes perpendicular to the rod support holes in the heater block and positioned such that the rods deform the rubber and are thereby pressed against a surface of the rod support hole. In alternative embodiments, V-grooves are formed in the heater block to support the rods. The heater block is brass in some embodiments and barium titanate in others. For brass blocks, the rods are beryllium oxide For barium titanate heater blocks, the rods can be either beryllium oxide or barium titanate.

12 Claims, 4 Drawing Sheets

LOW PROFILE HEATER AND SUPPORT ASSEMBLY FOR YIG SPHERES

BACKGROUND OF THE INVENTION

The invention pertains to the field of YIG devices, and, more particularly, to the field of heater designs for YIG spheres.

YIG devices must typically operate over a very wide range of temperatures. Since certain properties of YIG spheres are temperature dependent, the practice was adopted in the prior art of using heaters to heat the rods which support the YIG spheres thereby heating the spheres. This caused the temperature of the spheres to be under the control of the designer of the YIG device and not be subject to the ambient conditions. This allowed the designer to have better control over the performance of the YIG device by reducing the effect of ambient temperature as a design factor.

FIG. 1 shows an early prior art YIG filter heater design. A heater block 10 supports a brass collet 12 of a sphere support assembly. The brass collet 12 is coupled to a beryllium-oxide rod 14 which has a YIG sphere 16 mounted at the tip thereof. Typically, the YIG sphere is 0.010 to 0.026 inches in diameter. The heater block 10 has a slot cut therein which is crimped before the brass collet is inserted so as to form a press fit between the heater block and the brass collet to provide solid contact for better heat transfer efficiency. Twin heater pellets 20 and 22 are affixed to flat surfaces 24 and 26 of the heater block so as to transfer heat to the heater block from the positive temperature coefficient barium titanate heater pellets that function as heater elements.

This design was used in the early 1980's. The drawback of this design was that the only contact between the heater block and the brass collet was at the crimped edge of the heater block. This led to a small area of contact between the heater block and the brass collet which impaired the heat transfer efficiency. Also, the heat transfer path from the heater pellets and YIG sphere was complex in that many interfaces had to be traversed. Specifically, heat from the heater pellet passes to the heater block and from there to the brass collet. From the brass collet, the heat passes to the beryllium-oxide rod and from there to the YIG sphere.

FIG. 2 shows a later prior art heater design. In this design a brass heater block 30 has holes formed therein to receive the beryllium-oxide rod 34 of each of a plurality of YIG support rods. Hole 40 is typical of these holes. The sphere rod 34 of each YIG support rod assembly rests in a corresponding trough 36 formed in a step part 38 of the heater block so as to be aligned with the hole 40. The sphere rods are clamped down to the heater block in their respective troughs by a beryllium copper spring clip 42 which is fastened to the heater block via a pair of screws 44 and 46. A rubber gasket 48 may be interposed between the spring clip and the heater block.

The design of FIG. 2 is very complicated to manufacture and does not always apply equal clamping pressure to each sphere rod assembly. This tends to result from bowing of the spring clip caused by the pressure exerted by the screws 44 and 46. This tendency is somewhat alleviated by the inclusion of the gasket 48, but results in a design which is overly complicated and difficult and expensive to manufacture.

In another prior art design by Trak Microwave, Inc., a heater block having a piano wire spring element incorporated therein was used to support the YIG support rod. The piano wire was run through the heater block in such a way that when the YIG support rod was inserted, the piano wire was deflected so as to bias the YIG support rod against the wall of the guide hole.

Therefore a need has arisen for a simple, easy to manufacture heater design which applies equal pressure to all sphere rod assemblies to clamp all rods to the heater block and insure equal heating of each sphere.

SUMMARY OF THE INVENTION

According to the teachings of the invention, there is disclosed a heater assembly for YIG filters and other YIG devices which employs a heater block having a plurality of holes formed therein to receive a plurality of sphere rods. In the preferred embodiment for single YIG sphere support rod devices such as YIG oscillators, the heater block is made of barium titanate through which a single hole is formed, typically by diamond drilling. A single beryllium-oxide YIG sphere support rod is inserted in this hole and is held in place with a single O-ring which encircles the heater block and has a thickness and position on the heater block which causes an interference between the O-ring and the beryllium-oxide YIG support rod. Preferably, this O-ring is a Buna-N (nitrile) rubber, and the interference between this O-ring and the beryllium-oxide rod is typically about 0.005–0.007 inches. This interference biases the beryllium-oxide support rod against the top of the hole formed in the heater block to insure good thermal contact all along the length of the rod. The interference also causes the beryllium-oxide rod to consistently locate the center of the YIG sphere in space as the rod is turned to tune the YIG device.

Barium titanate is used for the heater element because it is more or less self regulating and typically stabilizes at a temperature of 90 degrees centigrade plus or minus 5 degrees. However, despite the tight temperature regulation of the barium titanate, nonzero thermal resistance between the barium titanate heater pellet(s) and the YIG sphere will cause the temperature of the sphere to vary more than plus or minus 5 degrees centigrade if the ambient temperature of the air surrounding the sphere changes drastically such as between typical military temperature limits. This process can be visualized as a thermal voltage divider where the air-sphere interface represents a high thermal resistance, the path between the sphere and the heater pellet represents a low thermal resistance and the variation of the air temperature represents a voltage source with changing voltage. In this analogy, the sphere represejts the tap point in a voltage divider, and the temperature of the sphere represents voltage at this tap point. When the ambient temperature varies widely, this "voltage" swing is reflected in a voltage swing at the tap point i.e., temperature variation at the tap point. The amount of this temperature swing depends upon the temperature variation of the ambient and the relative thermal resistances of the air/YIG interface and the thermal path between the YIG sphere and the heater pellets. For a typical heater arrangement, the temperature of the sphere can vary by as much as about plus or minus 15 degrees centigrade when the ambient temperature changes from −55 degrees to 95 degrees Centigrade.

Typically, a tuning process is performed in YIG devices to rotate the sphere to its "zero-temperature" axis which is the orientation of the sphere wherein the frequency of the desired 110 mode does not change with changing sphere temperature. This is important to provide predictability to the frequency of this desired mode.

Because of this potential variation in temperature of the YIG sphere and the need to turn the sphere to locate its zero temperature axis, it is important in both YIG oscillators and YIG filters that the center of the YIG sphere remain at a consistent location in space as its support rod is turned. By orienting the spheres on the "zero temperature" axis, the minor changes in YIG sphere temperature which can result from thermal resistance between the heater and the YIG sphere can be tolerated. In addition, if the YIG sphere center were to change positions in space as the support rod was turned during the tuning process, the intensity of the magnetic flux to which the sphere was subjected could possibly change as the flux intensity may not be consistent at all points in space. This could cause unwanted variations in the YIG sphere resonant frequency which could cause alignment problems in YIG filters and unwanted frequency variations in YIG oscillators. Because the O-ring biases the YIG sphere support rod toward the top (or bottom) of its guide hole in the heater block, the effects of "play" from manufacturing tolerances or varying clearance between the support rod and its guide hole from device to device or from hole to hole in the same device can be eliminated as a factor in the tuning process.

In an alternative embodiment, the heater block is made of brass or barium titanate and has one or more holes drilled therein to receive one or more YIG support rods and make thermal contact directly with the beryllium-oxide support rod or rods as opposed to a brass collet on the support rod. Perpendicular holes are then formed in the heater block into which rubber dowels, i.e., rubber rods, are inserted. The position of the perpendicular holes and the sizes of the rubber dowels are such that an interference exists between the rubber dowels and the beryllium-oxide support rods. This causes the support rod(s) to be biased against their guide hole(s) thereby obtaining the benefits detailed above for the preferred embodiment. The heater block is rectangular in configuration with the holes for the sphere rods formed parallel to the short axis of the rectangular cross section. Two holes for the rubber dowels are formed parallel to the long axis of the rectangular cross section so as to have centerlines slightly above or below the plane defined by the centerlines of the holes for the sphere rods. In some embodiments, a single hole and a single rubber dowel may be substituted for the twin rubber dowels of the alternative embodiment. In some embodiments, the heater block is made of brass, although in other embodiments, the heater block is made of barium titanate which is the same material as the material of the heater pellets. For brass blocks, separate barium titanate heater pellets must be bonded to the surface of the heater block to heat it when current is passed through the heater pellets. In embodiments where the heater block is barium titanate, the heater block itself acts as the heater element.

The rubber dowels apply equal downward (or upward) pressure on the sphere rods to press them firmly against the inside bottom surface of the holes for sphere rods formed through the heater block. The rubber dowels also discourage axial movement of the sphere rods within the holes of the heater block.

In an alternative embodiment, the heater block will be made of barium titanate or brass and the guides for the beryllium YIG sphere support rods are formed as V-shaped grooves in the top or bottom surface of the heater block. An external O-ring is placed around the heater block is positioned and sized so as to be slightly stretched and so as to have an interference fit such as to bias the support rods into the grooves and stabilize them for good thermal contact and to eliminate play such that when the rods are turned, the YIG sphere centers do not move in space.

In an alternative embodiment useful for YIG filters, the heater block is made of brass or barium titanate and multiple holes for the YIG support rods are drilled therein. The YIG rods are then inserted in the holes, and a rubber O-ring is stretched around the outside of the block. The placement of the O-ring is such that there is an interference fit between the O-ring and the rods. That is, the O-ring is deformed slightly and exerts pressure on the rods thereby pressing them against the inside walls of the holes through the heater block.

In some embodiments, the support rod guide holes in the heater block will have two different diameter sections, a first section of each hole having a diameter large enough to receive a brass collet of the YIG rod support assembly, the second section of each hole having a diameter large enough to receive the sphere rod assembly.

Many different embodiments are possible using the teachings of the invention. All such embodiments are equivalent if they embody and implement the following unifying concepts. First, it is important that the heater block or whatever structure is used to support the YIG support rods have guide means which support and guide the YIG support rods such that all the rods can be turned with minimum alteration of the positions in space of the sphere centers of the YIG spheres affixed to the ends thereof. Second, it is important to be able to pass heat efficiently to the YIG support rods or to generate the heat directly in the YIG support rods themselves so that all rods are heated substantially equally and with as little heat loss as possible. It is preferred to eliminate as many interfaces between materials as possible in the path between the heat source and the YIG sphere and to simplify the design as much as possible by reducing the total piece part count. This also reduces the total thermal mass that must be heated without unduly increasing the cost to fabricate the device. Although it is not necessary for a particular embodiment to implement all of these requirements to fall within the teachings of the invention, as will be apparent from the embodiments detailed herein, the best performing embodiments will implement as many of these criteria as possible.

DETAILED DESCRIPTION OF THE PREFERRED EMBODIMENT

Figure 3:
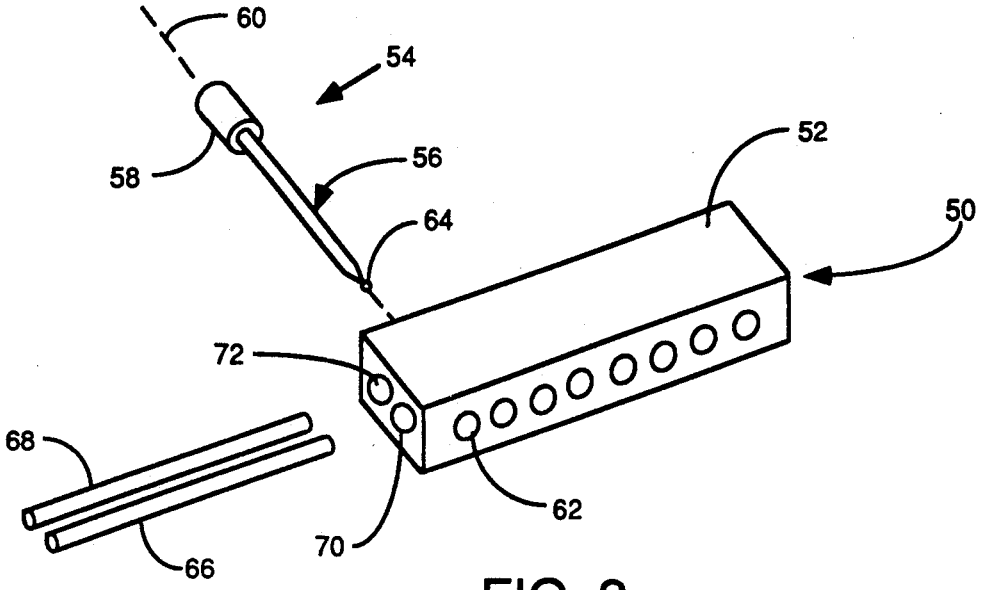
FIG. 3 is a perspective view of a YIG heater design according to the teachings of the invention.

Referring to FIG. 3, there is shown a perspective view of the preferred embodiment of a heater design according to the teachings of the invention. A heater block 50 having a rectangular configuration has at least one flat surface 52 and preferably two flat surfaces to which are bonded to barium titanate heater pellets (not shown). In the preferred embodiment, the heater block 50 is made of brass, but in other embodiments it can be made of other materials such as barium titanate. If made of barium titanate, the block 50 can be heated directly for better heat transfer properties by virtue of the elimination of at least one heat transfer interface between dissimilar materials, e.g. barium titanate and brass.

The heater block 50 has a plurality of holes drilled or otherwise formed therein for receiving a plurality of sphere rod assemblies of which sphere rod assembly 54 is typical. Hole 62 is typical of these holes. Each sphere rod assembly is comprised of a cylindrical sphere rod 56 and a cylindrical collet 58 both of which are concentric about a centerline 60. Typically, the sphere rod 56 is made of beryllium-oxide and the collet is made of brass. At the end of each rod a YIG sphere is mounted. The holes like hole 62 are each adapted to have a diameter which is sufficiently large to receive the sphere rods 56 and allow the rods to pass completely through the heater block so as to hold the YIG sphere 64 in the flux gap of a tuning magnet (not shown). In the preferred embodiment, the hole 62 and the other like holes in the heater block are not large enough in diameter to allow the brass collet 58 to pass therethrough. This causes the heater block to act as a stop to prevent the sphere rods from sliding through the heater block.

In alternative embodiments, the holes such as hole 62 will have a diameter which is sufficient in a first part to receive and support the brass collet 58 and which steps down to a smaller diameter sufficient to receive and support the sphere rods.

Figure 1:
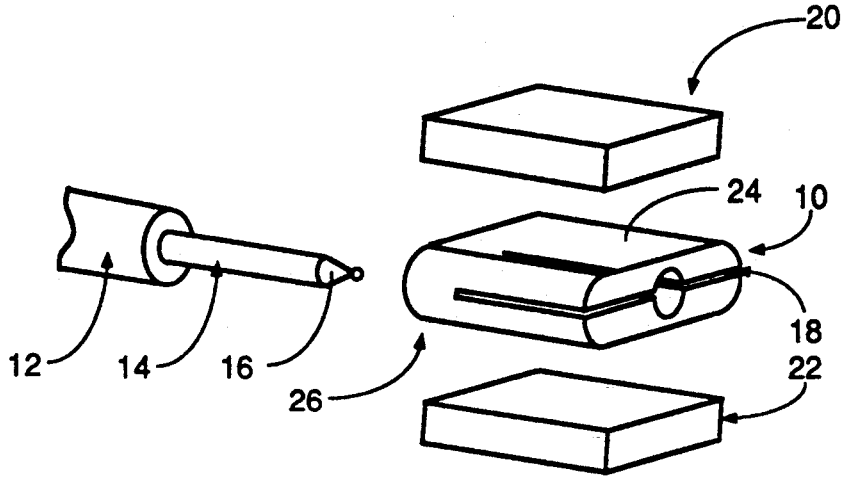
FIG. 1 (PRIOR ART)
FIG. 1 is a perspective view of a prior art heater assembly used in the early 80's.
Figure 4:
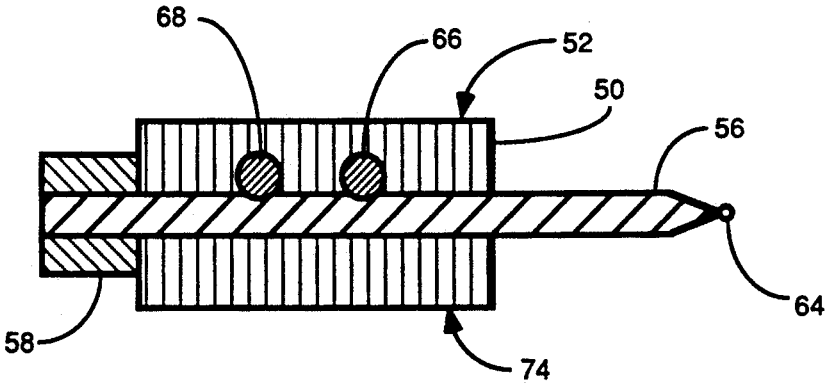
FIG. 4 is a cross sectional view of the heater design of FIG. 3 taken along the long axis of the YIG support rod.
Figure 5:
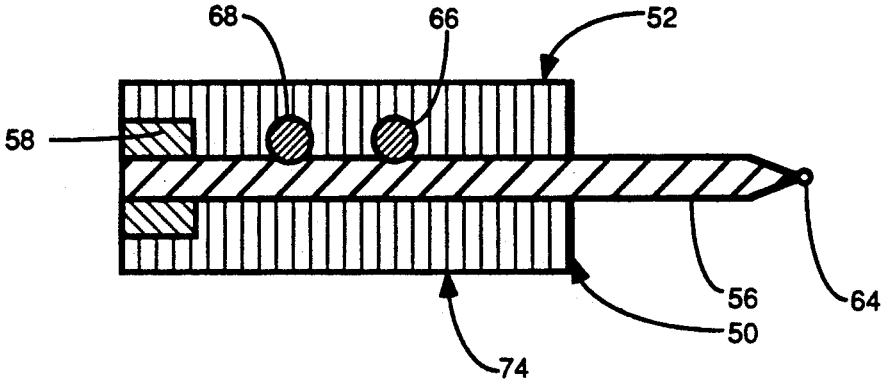
FIG. 5 is a cross sectional view of an alternative version of the heater design of FIG. 3 taken along the long axis of the YIG support rod.

FIG. 4 shows the embodiment of FIG. 3 in cross section with sphere rod inserted up to the collet. FIG. 5 shows an alternative species embodiment within the genre represented by the device depicted in FIG. 1 in cross section with the collet inside the heater block.

According to the teachings of the invention, two rubber dowels 66 and 68 are inserted into two parallel holes 70 and 72 formed in the heater block to bias the sphere rods 56 downward in the holes of the heater block to insure uniform firm contact between sphere rods and the holes in the heater block. The holes 70 and 72 in FIG. 3 are formed parallel to the long axis of the heater block 50. These holes are positioned such that they intersect the holes 62 etc. such that when the rubber dowels 66 and 68 are installed in the holes 70 and 72 and the sphere rods are also inserted into their respective holes, the rubber of the rubber dowels presses down on all the sphere rods equally. This prevents axial movement of the sphere rods and promotes equal thermal conductivity between the sphere rods and the heater block thereby rendering more uniform and predictable heating of the spheres.

Figure 2:
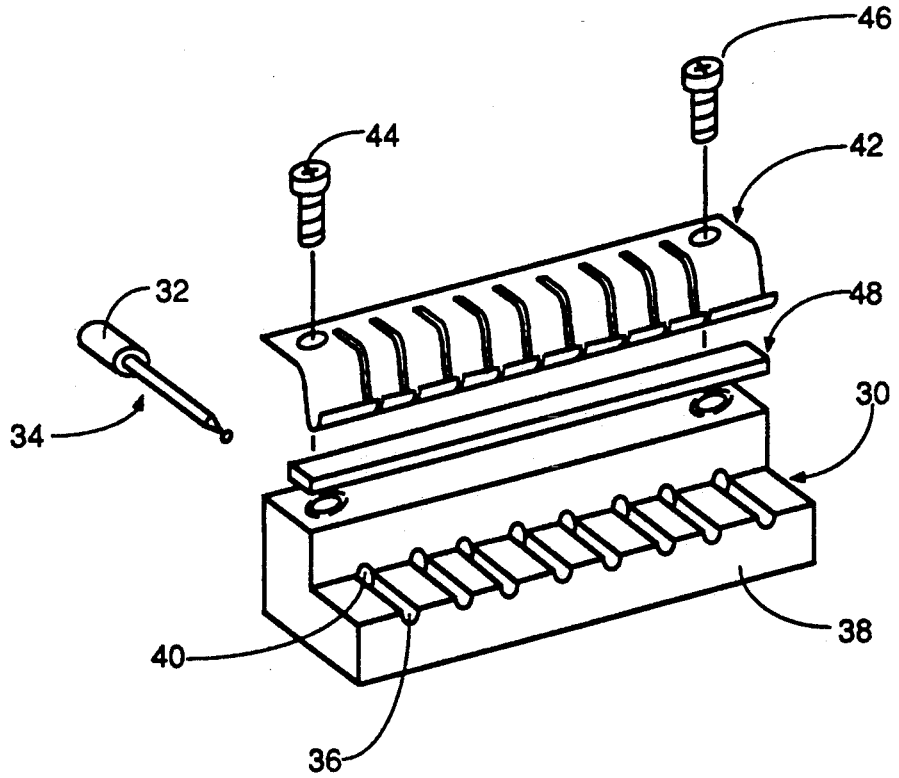
FIG. 2 (PRIOR ART)
FIG. 2 is a perspective view of a prior art heater assembly used later than the design of FIG. 1.

The simple design of the heater block systems shown in FIGS. 3–5 makes the heater system easy to construct, cheaper and less susceptible to the problem of prior designs of not applying equal force to all sphere rods thereby causing heating of the spheres to be uneven. The embodiments of FIGS. 3–5 are improvements over the prior art designs of FIGS. 1 and 2 because the heat transfer between the heater block and the sphere rods is improved. This results from greater contact area between the heater block and the sphere rods and more uniform pressure forcing all the sphere rods to seat in their respective holes equally. Further, the heat flow path from the heater blocks to the YIG spheres is simpler in the embodiments employing barium titanate heater blocks in that the heater block heats the sphere rod(s) directly which then heats the YIG sphere(s). In some embodiments, the YIG rods themselves are made of barium titanate thereby shortening and simplifying the heat conduction path to the spheres further. These shorter, less complex heat paths of the invention tend to cause more uniform heating of the YIG spheres as there are fewer interfaces to traverse which may have different thermal conductivity or heat transfer properties as between sphere rods.

Despite the added thermal interface, use of a brass sleeve for the beryllium-oxide YIG support rods may be desirable as beryllium-oxide is brittle and subject to breaking. The brass sleeve, similar to that depicted in FIG. 1, would prevent the beryllium-oxide YIG support rods from breaking as the rods are turned during tuning.

A significant property of the heater assembly shown in FIGS. 3–5 is the low profile, i.e., the small distance between the flat surfaces 52 and 74 to which the heater pellets are bonded. This leaves more room within the magnetic structure for other components.

Figure 6:
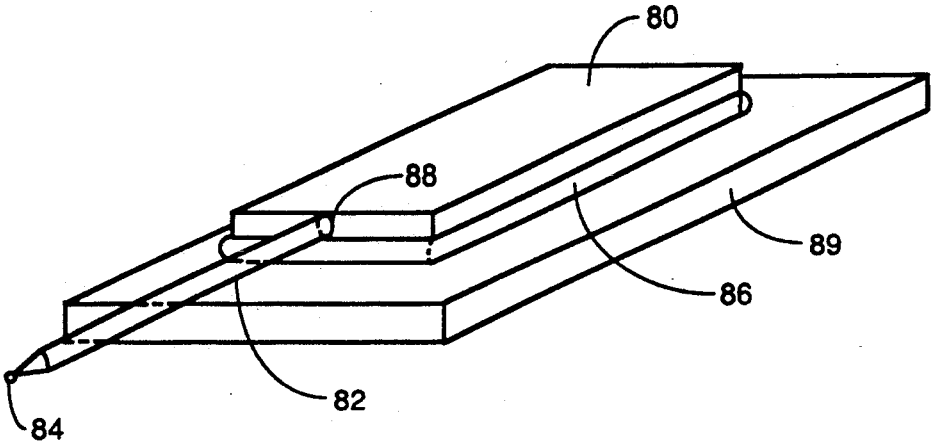
FIG. 6 is a perspective view of the preferred embodiment of a heater design for a single stage YIG device such as a YIG oscillator.

Referring to FIG. 6, there is shown the preferred embodiment for a single stage YIG heater design such as can be used in a YIG oscillator. In this embodiment, the heater block 80 is made of barium titanate, and has a single hole formed therein through which the beryllium-oxide YIG support rod 82 passes and is guided and supported thereby such that the rod 82 can be rotated around its long axis. Rotation of the YIG support rods is needed to get the YIG sphere to resonate at the proper frequency and to minimize changes in frequency of the 110 mode with changing temperature. When electrical current is passed through the heater block 80, the block will be heated. The heater block directly heats the YIG support rod 82, and the heat is transferred along the beryllium-oxide rod to a YIG sphere 84 mounted at the end of the support rod. A single rubber O-ring 86 is stretched around the perimeter of the heater block 80 and is sized and positioned such that the rubber of the O-ring has an interference with the YIG support rod 82 and is deformed thereby. This biases the YIG support rod upward at both ends of the heater block 80 thereby removing any play or clearance between the rod and the guide hole 88. This insures that when the rod 82 is rotated around its long axis, the play or clearance does not become a factor which could cause the center of the YIG sphere 84 to move in space. The heater block is mounted on an insulating plate 89 which helps hold the O-ring in position between the guide holes and the edge of the heater block so as to form the desired interference fit.

The O-ring 86 is preferably built of Buna-N (nitrile) rubber of hardness 70 shore A or better although other softer rubbers may also work. This rubber is used in many O-rings in military and automotive applications and is rated to approximately 150 degrees centigrade. Such rubber O-rings are available from Apple Rubber Products under Apple compound designation BN and is also referred to generically as ASTM D1418 Designation NBR and XNBR. This type rubber is available commercially from Goodyear under the tradename Chemigum TM and from B.F. Goodrich under the tradename Hycar TM as well as from several other manufacturers. The rubber is comprised of copolymer butadene and acrylonitrile by varying proportions. Increasing acrylonitrile content gives Nitrile rubber better resistance to petroleum based oils and fuels and enhanced resistance to degrading effects of heat at a cost of decreased low temperature performance.

Conversely, decreasing acrylonitrile, while increasing butadene content, provides better low temperature flexibility. Care should be taken to avoid exposure of the O-ring to highly polar solvents such as Acetone, MEK, Chlorinated Hydrocarbons and Nitro Hydrocarbons which are known to cause rapid and extreme deterioration.

Figure 7:
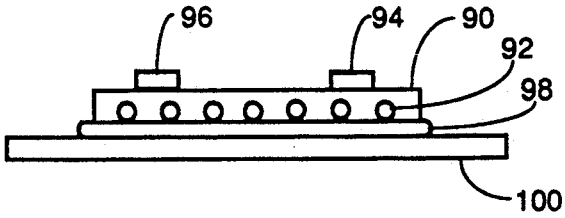
FIG. 7 is an elevation view of the presently preferred embodiment of a multistage heater block design using a brass heater block.

Referring to FIG. 7, there is shown an elevation view of another single O-ring embodiment using a brass heater block 90 and a plurality of parallel rod support holes such as hole 92 and one or more barium titanate heater pellets 94 and 96. The heater pellets are electrically coupled to wires, not shown, and are heated when current passes therethrough. Typically, one D.C. supply line will be attached to one heater pellet and the return line will be coupled to the other pellet so that current flows through the first heater pellet, into the brass block and into the other heater pellet. The barium titanate of the heater pellets acts as self-regulating heater in that at room temperature, the barium titanate has a very low resistance, so heating proceeds rapidly because of high current flow. When the temperature reaches about 90 degrees Centigrade, the resistance of the barium titanate rises rapidly thereby cutting down the current flow and reducing the heating. As the pellet cools off, the resistance drops again, current flow increases and the temperature rises. Thus, the temperature of the barium titanate chip remains relatively constant. A single Buna-N (nitrile) O-ring 98 is stretched around the perimeter of the heater block and is positioned between the holes 92 and an insulating plate 100. The size and position of the O-ring is such that an interference fit exists between the O-ring and the YIG sphere support rods which extend through the holes 92. This causes the rubber O-ring to be deformed by the support rods which biases the rods upward against the tops of the guide holes 92. This eliminates any play between the support rod and the guide hole 92 and insures that each support rod has uniform pressure applied to it to seat it against the top wall of the guide hole in the heater block. This allows the rods to be turned during the process of tuning the filter to align the center frequencies of the YIG spheres without the play from hole to hole causing the YIG sphere centers to vary their positions in space as the rods are turned. It also insures that all rods and YIG spheres are heated equally.

Figure 8:
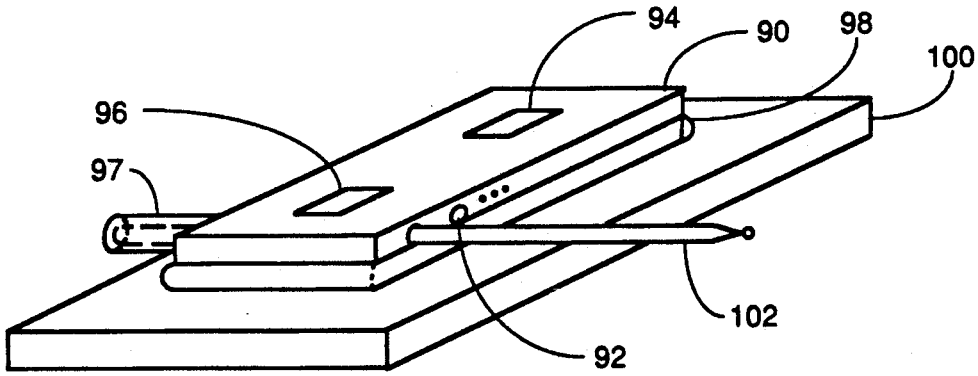
FIG. 8 is a perspective view of the embodiment of FIG. 7.
Figure 9:
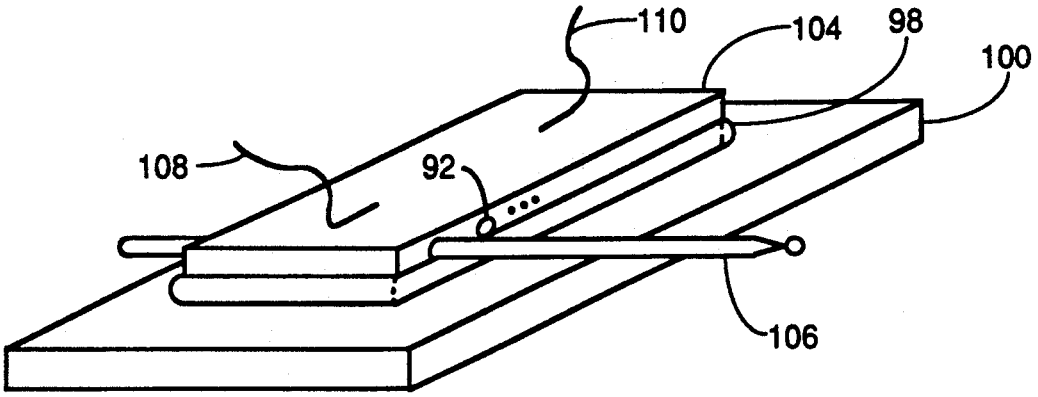
FIG. 9 is a perspective view of another embodiment employing a barium titanate heater block and either beryllium YIG support rods or barium titanate YIG support rods.
Figure 10:
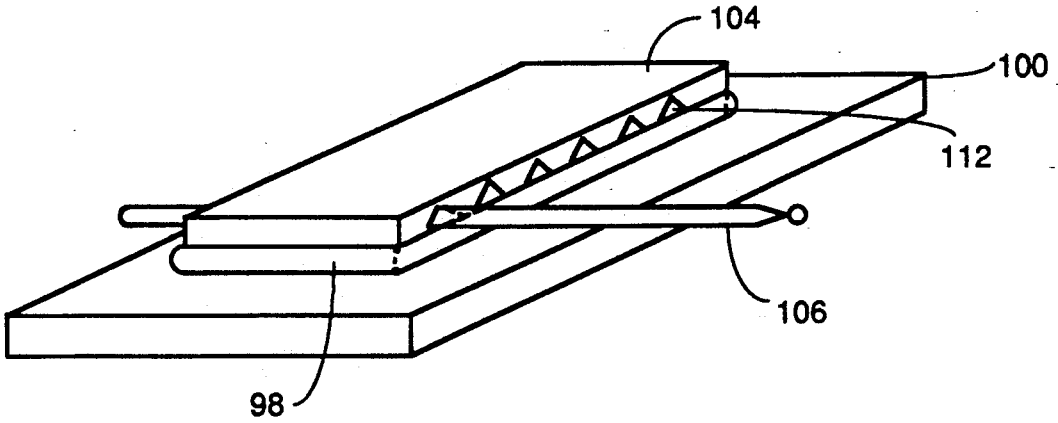
FIG. 10 is a perspective view of a single stage V-groove embodiments which can be extended to a multistage design.

FIG. 8 is a perspective view of single O-ring embodiment like that shown in FIG. 7. Like reference numbers indicate the same components shown in the elevation view of FIG. 7. Note that a brass collet 97 is shown on the end of the YIG support rod 102 opposite the end that the YIG sphere is affixed to. The function of the brass collet is to prevent the YIG support rod from being inserted too far. In some embodiments, the brass collet can be eliminated and some other means may be employed to ensure that the rod is not inserted too far. In the embodiments of FIGS. 9 and 10, no brass collets are shown, but they are preferably used to act as a stop.

FIG. 9 shows an alternative embodiment wherein a heater block 104 is formed of barium titanate and a support rod 106 is also formed of barium titanate. The reason brass is preferred for the heater block in the multiple support rod application needed for YIG filters is that it is very expensive to drill multiple long holes like hole 92 in barium titanate. In the future, as it becomes easier and cheaper to drill multiple, long holes in the barium titanate material or mold the holes in the material, it would be preferred to make the heater block 104 out of barium titanate. In such an embodiment, the support rods could be made of beryllium-oxide or barium titanate. In the embodiment of FIG. 9 with a heater block formed of barium titanate and support rods also formed of barium titanate, the D.C. power supply is coupled to the barium titanate heater block by wires 108 and 110. Some current flows through the heater block and some current flows through the barium titanate YIG sphere support rods themselves. The O-ring functions like the O-ring 98 in the embodiment of FIG. 8. The concept of making both the heater block and the YIG sphere support rod of barium titanate can be employed in the single stage embodiment shown in FIG. 6 and the two O-ring embodiment shown in FIG. 3. The advantage of the embodiments using barium titanate for the heater block and barium titanate for the YIG support rod is that when current flows through the heater block, it also flows through the YIG support rod and directly heats the rod 106. This creates a very simple heat flow path to the YIG sphere and reduces temperature gradients between the heater and the YIG sphere. Such gradients are undesirable because they can cause the YIG sphere to have a substantially lower temperature than the temperature of the heater. In such a case, when the ambient temperature changes enough, the temperature of the YIG sphere can change excessively with changing ambient temperature which is not a desired property since it alters the electrical characteristics of the YIG spheres such as the saturation magnetization value. The best thermal performance is achieved by forming the rod support guides in a barium titanate heater block, but this is expensive for multiple rod applications. In such applications, the best and least expensive way to implement the teachings of the invention is to make the heater block of brass and make the YIG support rods of beryllium oxide. When the heater block is made of brass, barium titanate YIG support rods cannot be used.

In alternative embodiments of the single stage and multiple stage embodiments disclosed herein, the heater blocks are made of a thermal and electrical insulator and the YIG sphere support rods are made of barium titanate with current being applied directly to the rods through brushes that make electrical contact to the rods while allowing them to rotate freely. Any brush arrangement that can accomplish this function is satisfactory to practice this embodiment.

Referring to FIG. 10, there is shown an alternative V-groove embodiment wherein the guides for the YIG support rods are V-grooves formed in the heater block. In this embodiment, the heater block 104 is made of barium titanate or brass and a plurality of V-grooves of which groove 112 is typical are formed in the bottom surface of the heater block. The YIG support rods such as rod 106 rest in the V-grooves and are held in place by a single external O-ring 98 which encircles the heater block. The O-ring presses the YIG support rods up against the V-grooves to stabilize them and prevent axial movement and wobbling of the sphere in space when the rods are turned.

Although the invention has been disclosed in terms of the preferred and alternative embodiments disclosed herein, those skilled in the art will appreciate numerous modifications that can be made without departing from the true spirit and scope of the invention. All such modifications are intended to be included within the scope of the claims appended hereto. For example, any nonferrous material in the class of positive temperature coefficient materials could be substituted for the barium titanate. Further, alumina could be substituted for the beryllium-oxide rods, and more than two O-rings could be used in place of two O-rings. Further, the O-rings can be placed in any fashion on the heater block so long as they bias the rod or rods into their guides. Further, in some embodiments, an active heater can be employed in which a sensor measures temperature and controls the temperature by regulating the power delivered to a resistive element.

Figure 11:
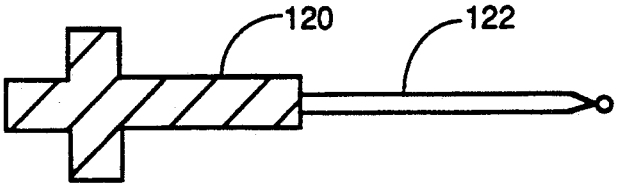
FIG. 11 is a cross sectional view of an alternative form of YIG support rod assembly that can be substituted for any of the BeO or barium titanate rods used in the embodiments disclosed herein.

Also, FIG. 11 shows an alternative type of YIG support rod assembly that is in common use and which can be substituted for any of the YIG support rods depicted in the embodiments disclosed here. In this rod assembly, a brass sleeve 120 is affixed to and supports the BeO or barium titanate YIG sphere support rod 122. The brass sleeve 120 is then inserted into the brass or barium titanate heater block. When using this assembly, the interference fit between the O-ring and the rod assembly in the embodiments of FIGS. 3, 6, 8, 9 and 10 occurs between the O-ring and the brass sleeve 120. This would not be the preferred structure however because it adds another interface across which heat must travel to get to the YIG sphere.

What is claimed is:

1. A heater structure for a YIG device, comprising:

one or more YIG spheres;

one or more nonferrous support rods having said YIG spheres affixed to the ends thereof;

a heater block having formed thereon one or more guides for said one or more support rods including means for heating said heater block an elastic member formed of rubber arranged on said heater block; so as to bias said one or more support rods against their guides so as to insure that all said support rods are thermally coupled to said heater block with substantially the same heat transfer efficiency.

2. A heater apparatus for a YIG device, comprising:

a YIG sphere;

a heater block formed of barium titanate having a rod support guide formed thereon;

a support rod having said YIG sphere mounted thereon, and resting on said rod support guide; and a rubber O-ring encircling said heater block on a perimeter line between said guide and an edge of said heater block and in contact with said support rod in such a way as to elastically bias said support rod against said guide.

3. A heater apparatus for a YIG device, comprising:

one or more YIG support rods, each of which has a long axis having YIG spheres affixed thereto;

heater means for heating said one or more YIG support rods and supporting one or more said rods in one or more guides such that the rods can be turned around the long axis thereof; and wherein said heater means includes rubber biasing means for pressing said one more YIG support rods into said one or more guides to push the rods firmly against a surface of said without hindering rotation thereof.

4. The apparatus of claim 3 wherein said heater means is a barium titanate block.

5. The apparatus of claim 3 wherein said rods and said heater means are made of barium titanate.

6. The apparatus of claim 3 wherein said heater means is a brass block having a plurality of guides formed thereon in which said YIG support rods are supported, and wherein said rubber biasing means is a rubber O-ring stretched around the periphery of said block and positioned so as to be deflected by said YIG support rods such that said YIG support rods are pushed against a surface of their respective guides.

7. The apparatus of claim 6 wherein said heater means includes a barium titanate pellet thermally coupled to said brass block and through which electrical current is passed, and wherein said rods are made of beryllium oxide.

8. The apparatus of claim 3 wherein said heater means is a barium titanate block having a single guide hole formed therein and wherein said rod is made of barium titanate, and wherein said rubber biasing means is a rubber O-ring stretched around the periphery of said block and positioned such that said rod deforms said O-ring and is biased by said deformation against a wall of said single guide hole.

9. The apparatus of claim 3 wherein said heater means is a barium titanate block having a plurality of V-grooves formed on the surface thereof, and wherein said rubber biasing means is a rubber O-ring stretched around the periphery of said block and positioned such that said rods each deform said O-ring and each is biased by said deformation against a surface of a corresponding V-groove.

10. The apparatus of claim 3 wherein said heater means is a brass block having a plurality of guide holes formed therein, and wherein said rods are made of beryllium-oxide, and wherein said rubber biasing means is at least one rubber rod inserted into a hole in said heater block and positioned such that said rods each deform said rubber rod and each rod is biased by said deformation against a wall of a corresponding said guide hole, and wherein said brass heater block is thermally coupled to at least one barium titanate heater pellet.

11. The apparatus of claim 2 wherein said support rod is made of barium titanate.

12. The apparatus of claim 3 wherein said heater means is a brass block having a plurality of V-grooves formed on a surface thereof, and wherein said rods are made of beryllium-oxide, and wherein said rubber biasing means is at least one rubber O-ring stretched around the perimeter of said brass block and positioned such that said rods each deform said rubber O-ring and each rod is biased by said deformation against a surface of a corresponding V-groove, and wherein said brass heater block is thermally coupled to at least one barium titanate heater pellet.

* * * * *